US007210588B1

(12) United States Patent
Ayon et al.

(10) Patent No.: US 7,210,588 B1
(45) Date of Patent: May 1, 2007

(54) MULTI-SEGMENT KNIFE BLOCK

(75) Inventors: Barbara Ayon, Los Angeles, CA (US); Wei Shen, San Gabriel, CA (US)

(73) Assignee: Tabletops Unlimited, Inc., Carson, CA (US)

( * ) Notice: Subject to any disclaimer, the term of this patent is extended or adjusted under 35 U.S.C. 154(b) by 219 days.

(21) Appl. No.: 10/974,199

(22) Filed: Oct. 26, 2004

(51) Int. Cl.
*A47F 7/00* (2006.01)

(52) U.S. Cl. ..... 211/70.7

(58) Field of Classification Search ..... 211/70.7, 211/70.6, 81, 96, 168
See application file for complete search history.

(56) References Cited

U.S. PATENT DOCUMENTS 2,736,426 A * 2/1956 Hamilton ..... 206/379
4,374,565 A * 2/1983 Neumann ..... 211/69.5
4,511,040 A * 4/1985 Tolentino ..... 206/553
4,537,315 A * 8/1985 Griffin ..... 211/70.6
4,669,617 A * 6/1987 Boeckmann et al. ..... 211/69.7

OTHER PUBLICATIONS

Cutlery Set, Macy°s—Housewares—Tools of the Trade Belgique Classique 20 Piece Cutlery Set, Oct. 21, 2004 (2 pages)—http:/ www.macys.com/catalog/product/index.ognc?ID=1113999 &CategoryID=7673&LinkType=CatDrop.
Tools of the Trade Belgique Classique 20 Piece Cutlery Set, Macy°s—Zoom Image—Microsoft Internet Explorer, Oct. 21, 2004 (2 pages)—http:/www.macys.com/catalog/product/ index. ognc?ID=111399&CategoryID=7673&LinkType=CatDrop.

* cited by examiner

*Primary Examiner*—Sarah Purol
(74) *Attorney, Agent, or Firm*—Blakely, Sokoloff, Taylor & Zafman, LLC

(57) ABSTRACT

A number of arms are coupled to a base. Each arm is to hold a blade of a respective knife, and is moveable relative to the other about a pivot axis. Other embodiments are also described and claimed.

16 Claims, 4 Drawing Sheets

MULTI-SEGMENT KNIFE BLOCK

An embodiment of the invention is related to kitchen knife blocks that store knives. Other embodiments are also described.

BACKGROUND

Kitchen utensils such as knives, forks, and spoons have typically been stored in a drawer underneath a countertop. Knives in particular, however, have also been stored in a dedicated block, typically made entirely of wood. Such a storage unit has typically been referred to as a "block" which is descriptive of the overall shape of the unit, as well as the fact that it is a solid compact piece of substantial material. Openings shaped in the form of slots are formed that run vertically down from a top surface and into the block, and in which the knives are inserted blade first.

More recently, the market has seen a knife block that contains multiple sections that appear to be attached to form a unit, where each section has slotted openings to receive either knives or a pair of scissors. The knives have end caps bearing text labels such as "slicer", "bread", "utility", and "paring" that appear to refer to the function of the particular knife.

BRIEF DESCRIPTION OF THE DRAWINGS

The embodiments of the invention are illustrated by way of example and not by way of limitation in the figures of the accompanying drawings in which like references indicate similar elements. It should be noted that references to "an" embodiment of the invention in this disclosure are not necessarily to the same embodiment, and they mean at least one.

DETAILED DESCRIPTION

Figure 1:
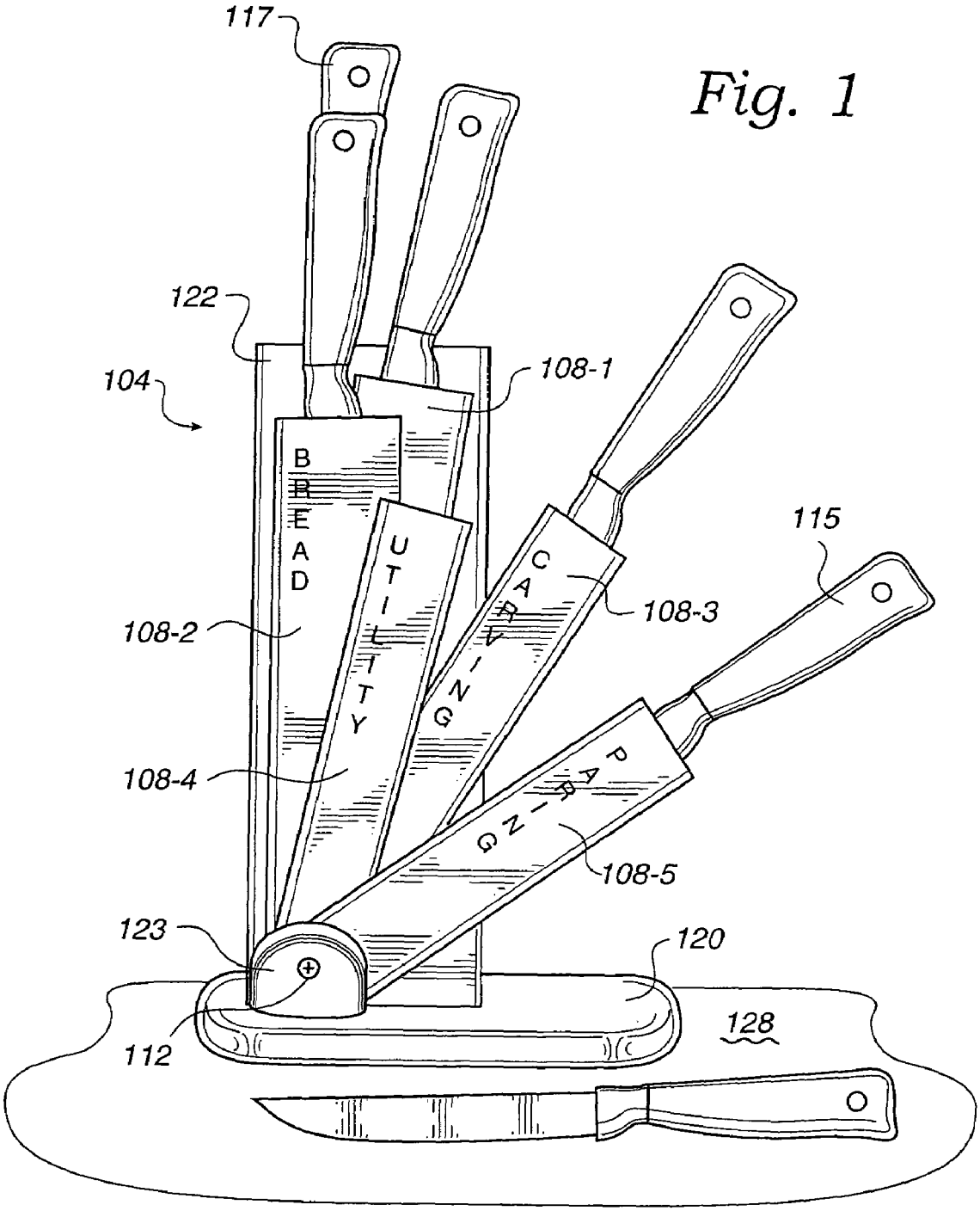
FIG. 1 is a front elevation view of an example multi-segment knife block, with a particular configuration of the segments.

Beginning with FIG. 1, an embodiment of the invention being a kitchen utensil storage unit 104 with multiple segments is shown. In this example, the storage unit 104 is also referred to as a "knife block", because it provides storage for a number of knives on a kitchen countertop, although as explained below it is quite different than a conventional block.

In the example FIG. 1, the storage unit 104 has, but is not limited to, five arms or segments 108_1 . . . , 108_5, all of which are coupled to a pivot shaft 112. There is an opening 310 near a bottom end of each segment 108 for the pivot shaft to pass through (see FIG. 3 which shows some of the segments 108 unstacked, next to each other, for purposes of explanation).

Figure 2:
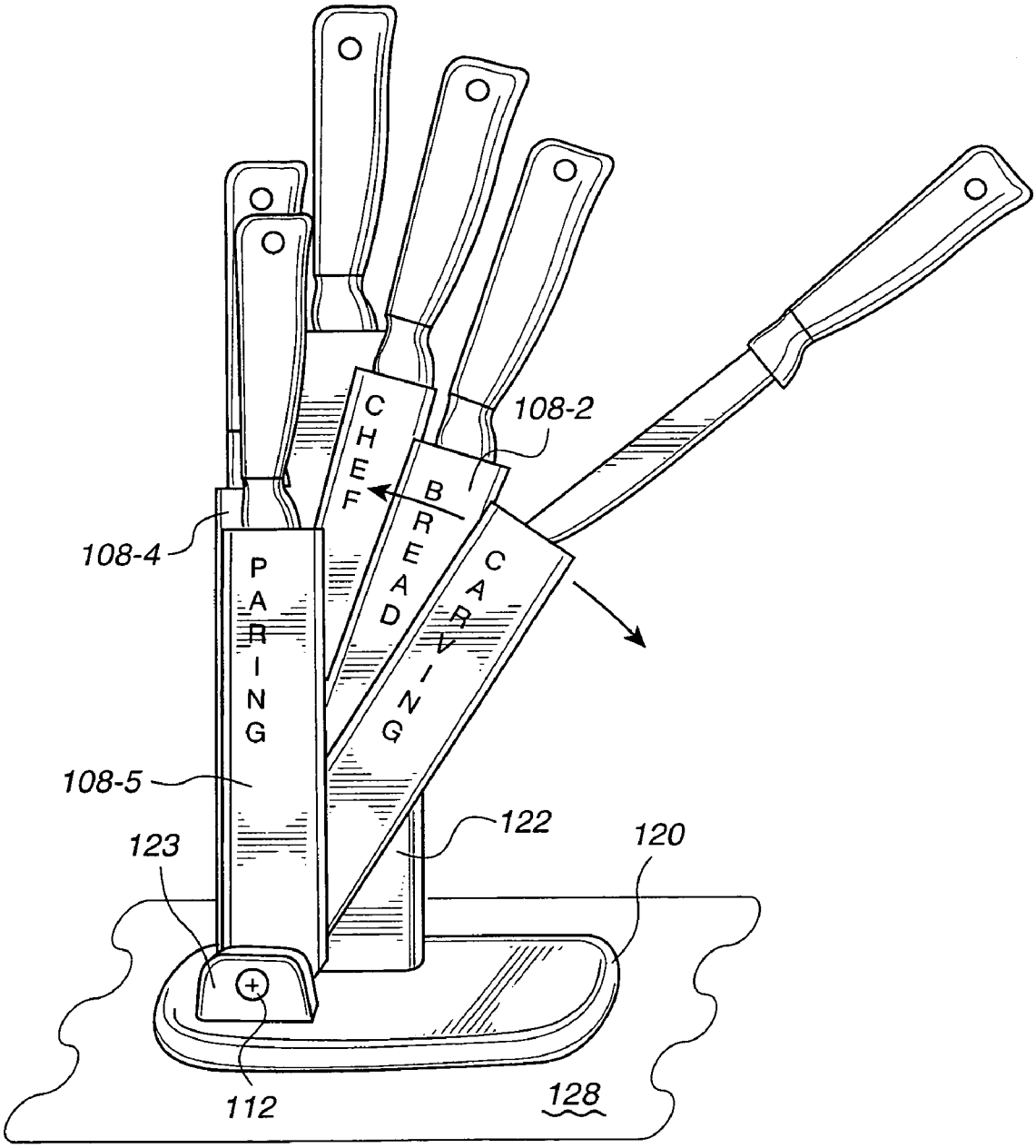
FIG. 2 is a front elevation view of the example multi-segment knife block, with another configuration of the segments.
Figure 4:
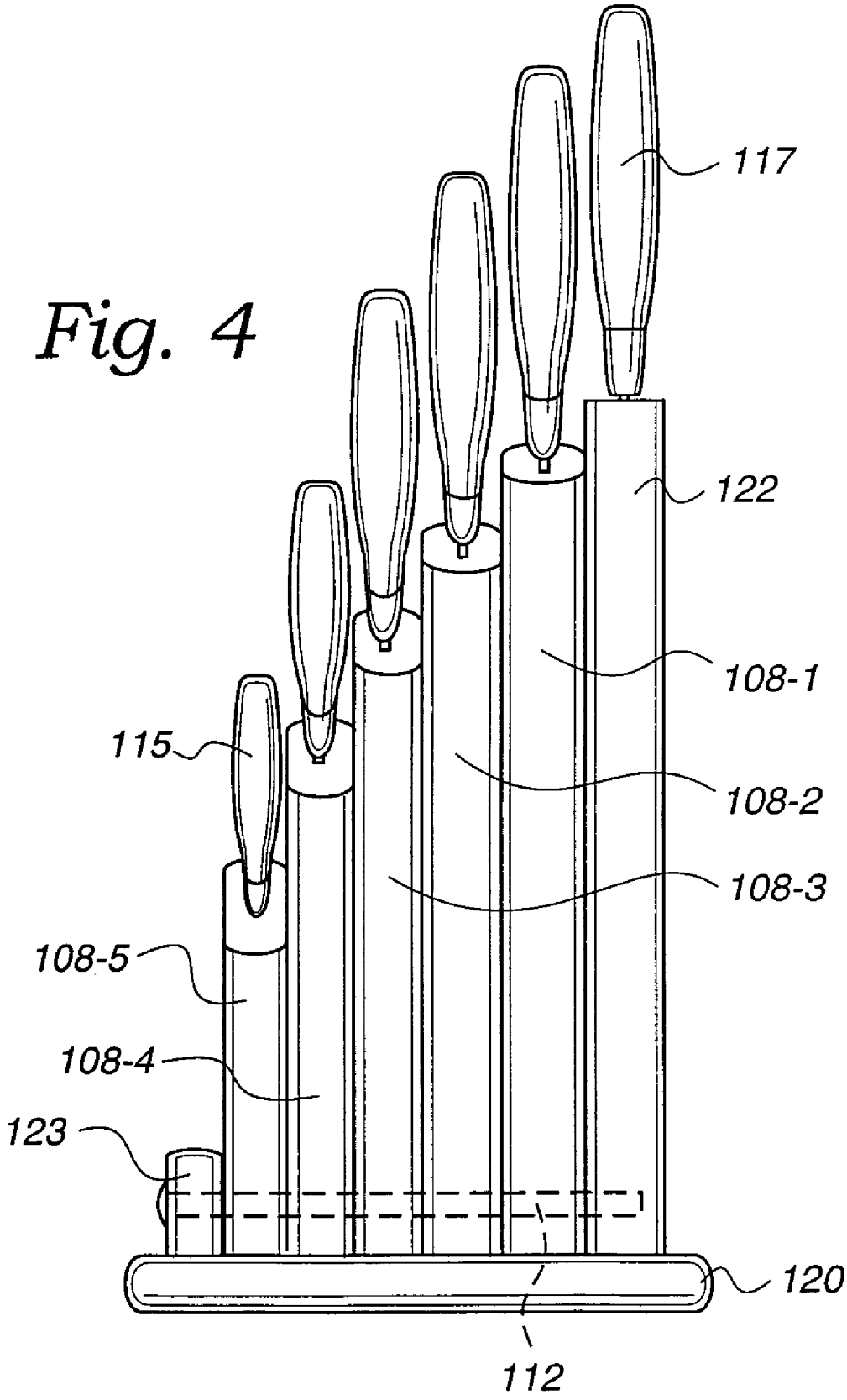
FIG. 4 is a right elevation of the multi-segment knife configured so that adjacent segments are at similar pivot angles.

Each segment 108 is shaped and coupled to the pivot shaft, so that each segment is moveable relative to another one, about the pivot shaft 112. Each of the segments 108 may be pivoted with respect to another, where a different configuration of the segments is shown in FIG. 2. In that case, segments 108_4, 108_5 have been pivoted to the left (to an essentially vertical position), while segment 108_2 has been pivoted to the right. In the example shown, each segment 108 is bar-shaped (see the side view of FIG. 4), with a slotted opening at its top end, to receive, blade first, a respective knife 115. The cavity that is inside each segment 108 communicates with the slotted opening and is preferably long enough so that the blade of the respective knife lies entirely within the cavity as shown. In addition, the slotted opening is such that the respective knife cannot be rotated while it is being inserted into the cavity. Each segment 108 may be made entirely of wood.

In the embodiment shown in FIG. 1, the storage unit 104 also has a base 120. The base 120 may be used to support the segments 108 on its top surface as shown, while resting on a kitchen countertop 128. This is an example of how the storage unit 104 would preferably be sold in a housewares retail establishment, for use while lying on the kitchen countertop 128.

Figure 3:
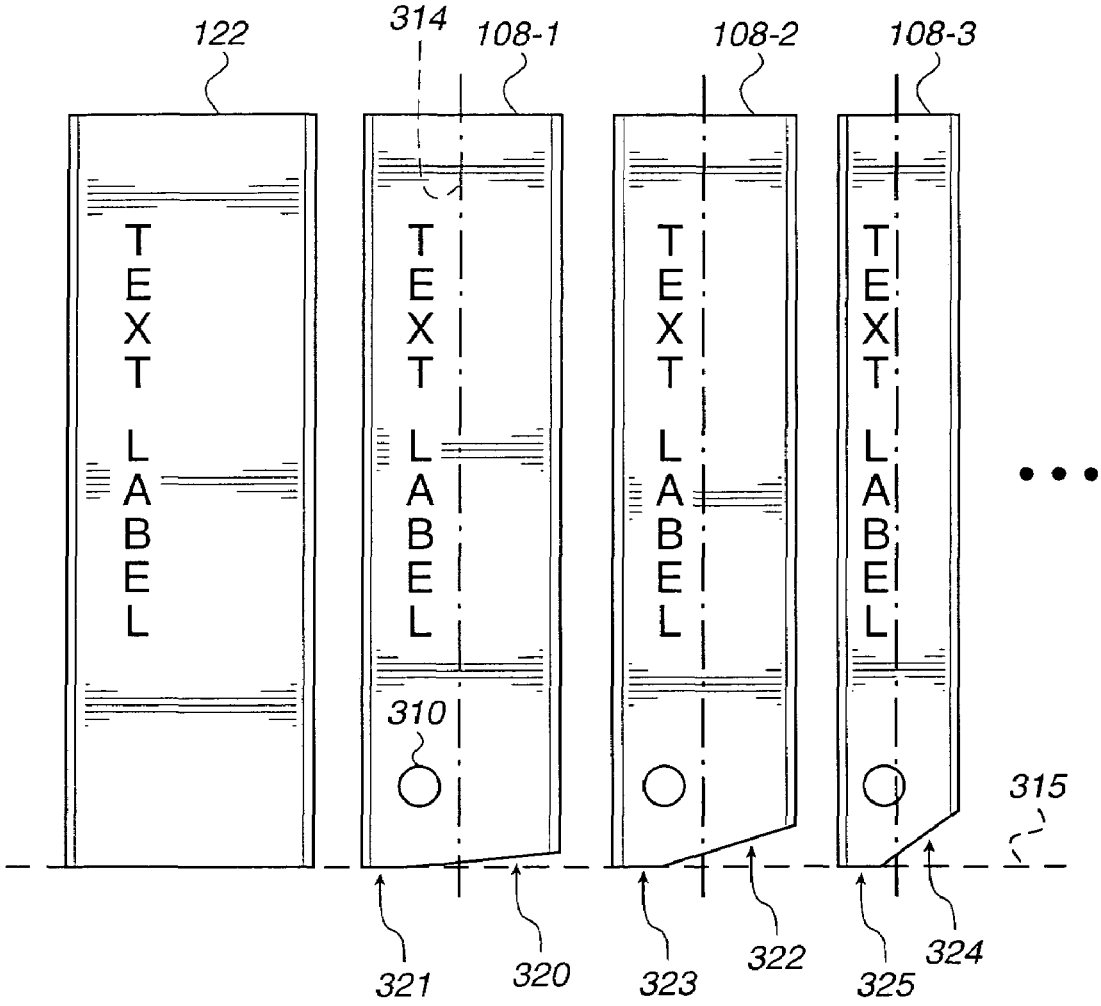
FIG. 3 is a front view of example segments arranged from largest to smallest and illustrating their progressively increasing angled bottom ends.

To help secure the segments 108 to the base 120, the example of FIG. 1 uses a first end piece 122 that adjoins a far end (or backside) of the segment 108_1. The end piece 122 is immovable relative to the base 120, e.g. it may be rigidly affixed to the base 120 via screws and glue, or some other attachment mechanism, or it may be integrated with the base 120 such as in a molding. In addition, a second end piece 123 that adjoins a near end (or front side) of the segment 108_5 is provided that is also immovable relative to the base 120. The pivot shaft 120 in this case pulls the first and second end pieces 122, 123 towards each other, through the hole or opening 310 in each segment (FIG. 3). The pivot shaft 112 may include, for example, a single bolt or screw that is long enough to pass through the segments and then threads into the near end (front side) of the end piece 122, to hold the segments 108 together. As an alternative, the segments 108 may be pulled or held against each other by some other means, with the pivot shaft being merely for aligning the segments axially, i.e. along its longitudinal axis, and providing a pivot axis for the segments.

According to another embodiment of the invention, the first end piece 122 is also bar-shaped, substantially like the other segments 108, and has an opening to receive, blade first, another knife 117. The first end piece 122 in that case would have a further cavity that communicates with an opening at its top and is long enough so that a blade of the knife 117 can lie entirely within the cavity. Its slot may also be shaped so that the knife 117 cannot be rotated while being inserted into the cavity. As depicted in FIG. 1, the end piece 122 may have essentially the same shape as the segments 108, except that in this case it holds the largest knife 117.

In the embodiment of FIG. 1, each segment 108 has a respective front side that is parallel to that of another one of the segments, and on which a respective text label is positioned. For example, the adjoining front side of segment 108_4 bears the label "utility", and is parallel to the back side of segment 108_5. Both sides are also entirely flat so that the two segments may easily pivot past each other. In addition, the text labels in these examples are vertically oriented, with the letters that spell each word being arranged from top to bottom as shown (other arrangements for the text label on each segment are possible). The text labels are preferably positioned closer to the left side of each segment 108, to the left of a longitudinal center axis 314 (see FIG. 3). This positioning allows them to be easily recognized by a user who merely has to pivot the segments that are in the way, through a relatively short arc.

The respective text label on each segment may be used to textually describe a function of the respective knife. This function relates to one or more of the following characteristics of the respective knife: size and shape of blade; and size and shape of handle. Although in the embodiments illustrated here, there are six different knives each designed to perform a different function, the invention should not be limited by that as there may be a fewer number or a greater number of segments, some or all of which may not have any such text labels on the front sides.

Turning now to FIG. 3, a front view of example segments 108 arranged from largest to smallest are shown. In addition, at the far left of the figure, an example end piece 122 is shown. The segments and the end piece are vertically oriented, with a center longitudinal axis 314 that is perpendicular to a horizontal axis 315 (where the latter may be at the top surface of the base 120, see FIG. 1). The shape of the bottom ends of the segments are such that a corner piece has been cutoff or not formed leaving an angled surface 320, 322, or 324.

As can be seen in the example embodiments shown in FIG. 3, the angle between the horizontal axis 315 and the surface 320, 322, or 324 becomes progressively larger. For example, surface 320 is at a slightly smaller angle than surface 322, which in turn is at a slightly smaller angle than surface 324, where these angles are measured while maintaining the segments 108 upright, that is their longitudinal center axis 314 is perpendicular to the horizontal axis 315. This physical structure of the segments 108 allows each of the segments to have a different pivot range, once they have been assembled, between a respective first stop position and a respective second stop position. For example, the first stop position of each of the segments 108 happens to be one where the segment 108 is essentially vertical (perpendicular to the horizontal axis 315). That is due to the remainder surface 321, 323, or 325 of the bottom end of each segment 108 being essentially parallel to the horizontal axis 315. Thus, for example, as the segment 108_3 is pivoted to the left, as shown in FIG. 3, it will reach the first stop position once the surface 325 becomes parallel with the horizontal axis 315 (and lies essentially flat against the top surface of the base, preventing further rotation of that segment to the left). Similarly, the segment 108_2 reaches its first stop position as it is being pivoted to the left, when its bottom surface 323 becomes parallel with the horizontal axis 315. Finally, the same effect is achieved with segment 108_1, where the surface 321 becomes horizontal when the segment 108_1 has been pivoted to its vertical position (albeit over a much smaller pivot range, in this case, due to the shallow angle of the surface 320).

The different pivot ranges for the segments 108 may be such that the segments, when moved about the pivot shaft from their respective first stop positions to their respective second stop positions, go from being compact to spread out. For example, the second stop position corresponds to the angles made between the surfaces 320, 322, and 324 and the horizontal. If these are designed to be progressively larger, then the respective segments 108 in effect spread out (when viewed from the front, as in FIGS. 1 and 2) when they have been pivoted to their far right most position. Similarly, the first stop position corresponds to the angles made between the surfaces 321, 323, and 325 and the horizontal. If these angles are very close to each other, or essentially the same (e.g., about zero degrees for the example shown in FIG. 3), then their respective segments in effect become compactly arranged (once again, when viewed from the front direction) when they have been pivoted to their far left position.

It should be recognized, however, that not every segment need have a different pivot range. For example, some of the segments may have the same pivot range between the first and second stop positions. Alternatively, the pivot ranges may increase or decrease monotonically from one segment to the next, as achieved by, for example, arranging the angles of the bottom surfaces of the ends of the segments 108 as depicted in FIG. 3.

The invention is not limited to the specific embodiments described above. Although the segments shown in the figures are bar-shaped with progressively decreasing height, an alternative here may be to have all of the segments 108 and the end piece 122 be of the same size and shape, sufficiently large to store their respective knives. Also, other ways of implementing the first and second stop positions, in the pivot ranges, are possible. Accordingly, other embodiments are within the scope of the claims.

What is claimed is:

1. An article of manufacture comprising:

a kitchen utensil storage unit to store a plurality of knives, the unit having a plurality of segments that are coupled to a pivot shaft so that each of the segments is movable relative to another one of the segments about the pivot shaft, each of the segments having an opening to receive, blade first, a respective one of the plurality of knives wherein each of the segments has a respective front side that remains parallel to that of another one of the segments while the segment pivots about the pivot shaft, and on which a respective text label is positioned, allowing the respective text label to be fully exposed by pivoting one or more segments that are in the way and wherein the respective label textually describes a function of the respective knife.

2. The article of manufacture of claim 1 wherein each of the segments has a cavity that communicates with the opening and is long enough so that a blade of the respective knife lies entirely within the cavity and a handle of the respective knife lies outside the cavity, and the opening is a slot so that the respective knife can not be rotated while being inserted into the cavity.

3. The article of manufacture of claim 1 further comprising:

a base, a first end piece that adjoins one end of the plurality of segments and is immovable relative to the base, and a second end piece that adjoins another end of the plurality of segments and is immovable relative to the base.

4. The article of manufacture of claim 3 wherein the pivot shaft rigidly connects the first and second end pieces and wherein each of the segments has a hole through which the shaft passes.

5. The article of manufacture of claim 3 wherein the first end piece has a further opening to receive, blade first, another knife, and a further cavity that communicates with the further opening and is long enough so that a blade of said another knife lies entirely within the further cavity, and the further opening is a slot so that said another knife can not be rotated while being inserted into the further cavity.

6. The article of manufacture of claim 1 wherein the respective label textually describes the function that relates to one or more of the following characteristics of the respective knife: size and shape of blade, and size and shape of handle.

7. The article of claim 3 wherein each of the segments has a respective front side that is parallel to and adjoins a respective backside of another one of the segments, except for the segment that adjoins the second end piece.

8. The article of manufacture of claim 4 wherein each of the segments has a different pivot range between a respective first stop position and a respective second stop position.

9. The article of manufacture of claim 8 wherein the different pivot ranges are such that the segments when moved about the pivot shaft from their respective first stop positions to their respective second stop positions go from being compact to spread out.

10. An article of manufacture comprising:

a base; and a plurality of arms each to removably hold a blade of a respective knife, the arms being coupled to the base and being movable relative to each other about a pivot axis wherein each of the plurality of arms bears a respective label that textually describes a function of the respective knife and wherein each of the arms has a respective front side that remains parallel to that of another one of the arms while the arm pivots about the pivot shaft, and on which the respective text label is positioned, allowing the respective text label to be fully exposed by pivoting one or more arms that are in the way.

11. The article of manufacture of claim 10 wherein each of the plurality of arms has a near end and a far end, the near end having an opening through which the pivot axis passes, the far end having an opening to receive the respective knife blade first.

12. The article of manufacture of claim 10 wherein the respective label textually describes the function that relates to one or more of the following characteristics of the respective knife: size and shape of blade, and size and shape of handle.

13. The article of manufacture of claim 11 wherein the each of the arms has a different pivot range between a respective first stop position and respective second stop position.

14. The article of manufacture of claim 13 wherein the different pivot ranges are such that the arms when moved about the pivot axis from their respective first stop positions to their respective second stop positions go from being compact to spread out.

15. A method for using a kitchen knife comprising:

inserting a plurality of kitchen knives blade first into a plurality of slots, respectively, that are in a plurality of arms, respectively;

pivoting each of the plurality of arms about a pivot axis relative to one another wherein a front surface of the arm remains parallel to that of the others during said pivoting and bears a label describing a function of the kitchen knife; and pivoting one or more of the arms that are in front of another one of the arms, to fully expose the label that is on said another one of the arms.

16. The method of claim 15 further comprising:

pivoting the arms about the axis in one direction into a compact arrangement; and pivoting the arms about the axis in an opposite direction into a spread arrangement.

* * * * *